United States Patent [19]

Papavasilopoulos

[11] Patent Number: 4,653,657

[45] Date of Patent: Mar. 31, 1987

[54] TAMPER INDICATING PACKAGE

[75] Inventor: Vasilios Papavasilopoulos, Toledo, Ohio

[73] Assignee: Owens-Illinois, Inc., Toledo, Ohio

[21] Appl. No.: 820,034

[22] Filed: Jan. 21, 1986

[51] Int. Cl.[4] ..... B65D 41/34

[52] U.S. Cl. ..... 215/252

[58] Field of Search ..... 215/252

[56] References Cited

U.S. PATENT DOCUMENTS 4,394,918 7/1983 Grussen ..... 215/252

4,506,795 3/1985 Herr ..... 215/252

*Primary Examiner*—Donald F. Norton

*Attorney, Agent, or Firm*—John R. Nelon

[57] ABSTRACT

A tamper indicating package comprising a container having a neck with a threaded finish and a closure which includes a base wall and depending peripheral skirt having threads interengaging the threads of the container, and a tamper indicating band attached to the skirt by a plurality of circumferentially spaced frangible bridge members. The tamper indicating band includes a bead for engaging a complimentary bead on the container, and a segmented annular flange extending axially upwardly and inwardly from the lower edge of the tamper indicating band towards the base wall of the closure. The annular flange has its free edge formed with a plurality of segments such that the stiffness of the flange is reduced. In addition, the leading end of each segment is cut to a 30° angle. These two features facilitate the application of the closure to the container.

6 Claims, 9 Drawing Figures

TAMPER INDICATING PACKAGE

This invention relates to tamper indicating packages.

BACKGROUND AND SUMMARY OF THE INVENTION

In packaging of containers having closures thereon, it has been common to provide tamper indicating packages wherein the tamper indicating band is connected to the closure along the weakened line provided by a plurality of bridges and interengaging means between the band and the container are such that when the closure is unthreaded from the container, the band is severed along the bridge portions to indicate that the closure has been tampered with.

One recently patented example can be found in U.S. Pat. No. 4,394,918, issued to Jean Grussen on July 26, 1983. In this patent a threaded closure carries a hold ring that is joined to the bottom of the cap skirt by a series of breakable tabs and the hold ring has an inside diameter that is at least equal to the outside diameter of the cap skirt. A plurality of lock lugs supported on the ring are inclined upwardly and inwardly and are intended to hook behind a collar or mating ring on the container neck to prevent the hold ring from being lifted off the container neck when the cap is unscrewed. An unbreakable flange is provided between the cap skirt and the ring and serves as a hinge for the cap when it is unscrewed.

In U.S. patent application Ser. No. 623,659, filed June 22, 1984, now U.S. Pat. No. 4,550,844, having a common assignee with the present application, there is disclosed and claimed an arrangement wherein a continuous annular flange extends from the lower end of the tamper indicating band and is inclined upwardly and inwardly. Such an arrangement is effective but has the disadvantage in that continuous flange requires excessive force to apply the closure to the container.

Accordingly, among the objectives of the present invention are to provide a tamper indicating band with an improved arrangement for interengaging the closure with the container so that when the closure is removed the tamper indicating band remains on the container.

In accordance with the invention, the continuous annular flange is provided with a plurality of segments which extend from one bridge and ends at the next bridge and the leading edge of each segment is cut to an angle of about 30° to facilitate application of the closure.

DESCRIPTION

Figure 1:
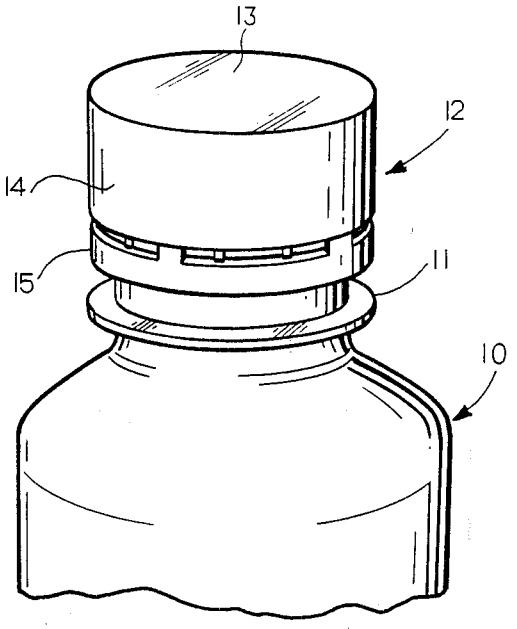
FIG. 1 is a fragmentary perspective view of a package embodying the invention.
Figure 2:
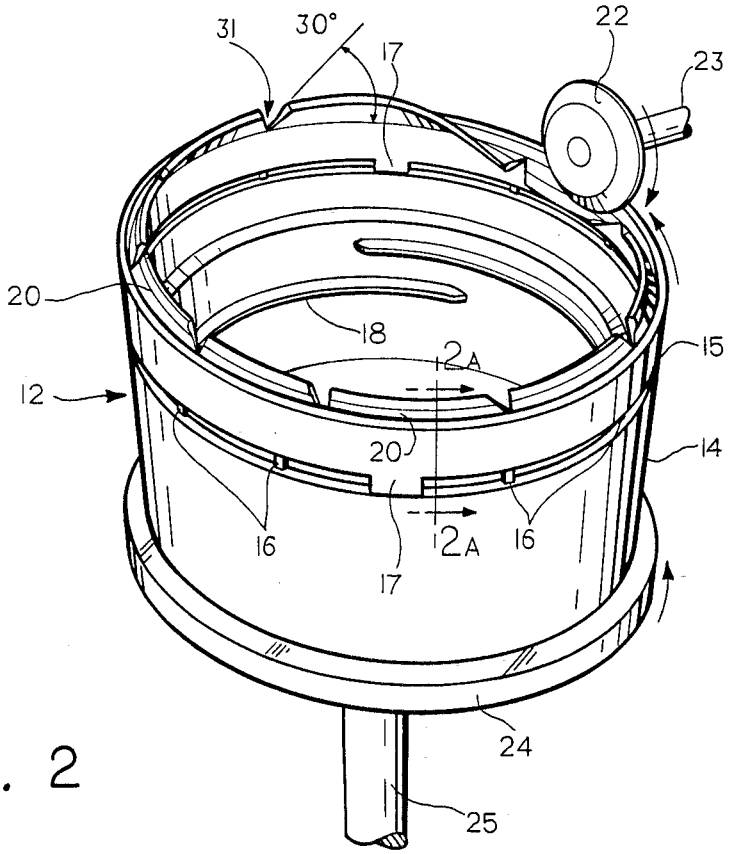
FIG. 2 is a perspective view of the closure of the invention in inverted position illustrating a post forming operation.
Figure 2A:
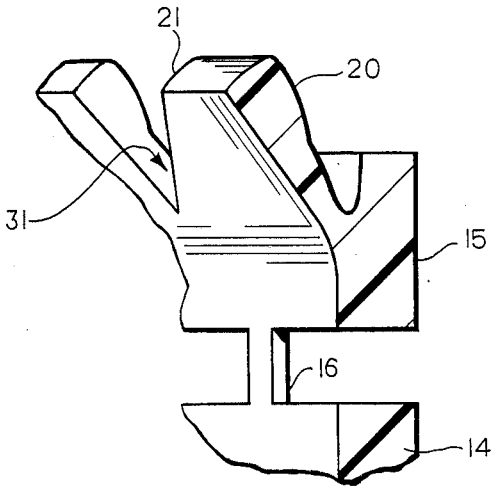
FIG. 2A is a fragmentary sectional view taken along the line 2A—2A in FIG. 2.
Figure 8:
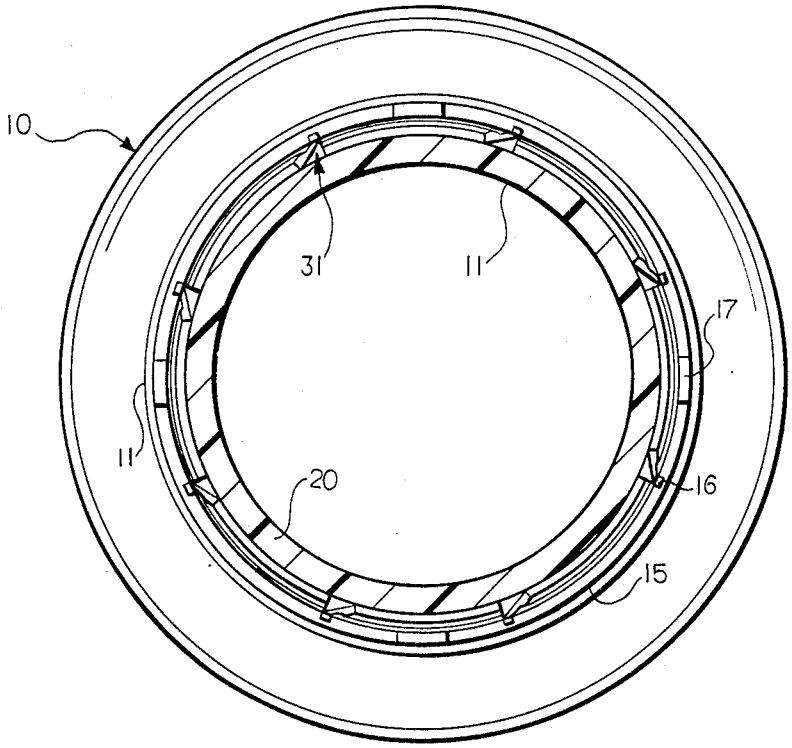
FIG. 8 is a sectional view taken along the line 8—8 in FIG. 4.
Figure 3:
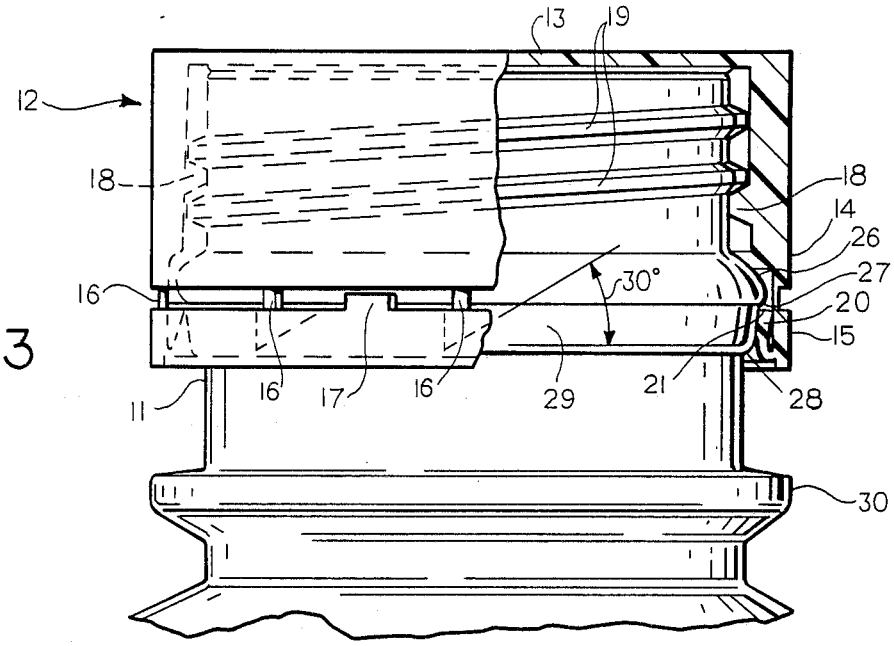
FIG. 3 is an enlarged, part sectional elevational view of a closure threaded on a container.
Figure 4:
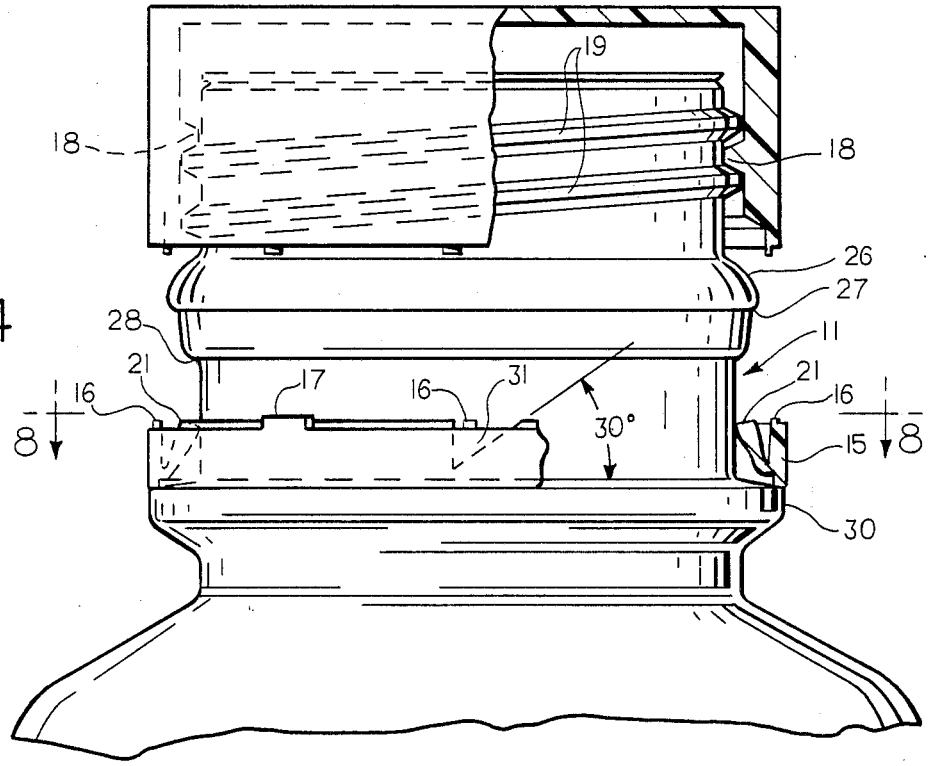
FIG. 4 is a view similar to FIG. 3 showing the closure partially removed.

With reference to FIG. 1 of the drawings, there is shown a container 10 having a finish or neck 11. Over the finish 11 is shown a closure generally designated 12. The closure 12 is formed of a thermoplastic material molded as a single unit and comprises a generally disc-shaped top 13 with a cylindrical depending skirt portion 14. Below the skirt 14, as shown in FIG. 1, there is provided a tamper indicating band 15. The band 15 is generally cylindrical and has essentially the same external diameter as that of the skirt 14 of the closure 12. The band 15 is joined to the lower end of the cylindrical skirt by a plurality of frangible bridges 16 (FIG. 2). In the specific embodiment as shown in FIGS. 2–4, there are eight frangible bridges 16. In addition, there are provided four spaced stops 17 which are formed integral with the band 15 and are primarily for use when the closures are molded so as to permit the pushing of the molded closure from the mold die without compressing the frangible bridges 16, yet permit the removal of the closure with attached tamper indicating band 15. The band stops 17 are not attached to the lower skirt of the closure in any way. As best seen in FIGS. 3 and 4, the cylindrical skirt 14 of the closure 12 is provided with internal threads 18. The threads 18 cooperate with externally formed threads 19 on the finish or neck 11 of the container 10.

Within the inner dimension of the tamper indicating band 15 there is an integrally formed annular stop ring 20 segmented by cuts 31, and when the cap is initially formed, it will take the configuration shown in FIG. 2. With the stop ring in the inverted form shown in FIG. 2, the stop ring 20 will extend inwardly and upwardly relative to the tamper indicating band 15 with an included angle of approximately 30°. As perhaps can be best seen in FIGS. 3 and 4, the stop ring 20 is integrally formed to the indicator band 15 and has a free end 21 of somewhat thicker configuration than the thickness of the connection between the ring and band 15. Immediately after the closure 12 is molded in the shape illustrated in FIG. 2, the closure will be rotated about is central vertical axis, parallel to the cylindrical skirt, and at the same time the stop ring 20 will be engaged by a beveled rotating wheel 22. The wheel 22 is shown as being mounted on a shaft 23, it being understood that the shaft 23 will be driven by any suitable drive means. Furthermore, as shown in FIG. 2, the closure 12 is depicted as being positioned on a rotating pad 24 carried at the upper end of a shaft 25. With the closure being rotated on the pad 24 and the wheel 22 rotating in engagement with the stop ring 20, the stop ring will be forced to bend downwardly and inwardly in the inverted position of the cap, as shown in FIG. 2, with the stop ring being pushed through an angle of approximately 120° from the "as-molded" angle. This rolling-in of the stop ring is done fairly soon (within seconds) after the molding of the closure and the stop ring 20 will then maintain this rolled-in position since the cure time for the plastic will not have been exceeded before the rolling-in is accomplished.

The finish 11 of the container 10, as best seen in FIG. 3, has a radially outwardly curved bead 26 formed therein which extends outward to an extent somewhat greater than the external dimensions of the threads 19. The bead 26 has a lower ledge 27 which may be termed a breaker ledge. As best seen in FIG. 3, when the closure 12 is threaded down over the container finish 11, the stop ring 20 will have its free end 21 positioned beneath the upper bead 26 and either in engagement with or closely spaced beneath the breaker ledge 27. The finish 11 of the container also is formed with a second radial ledge 28 which is below the bead 26 and its breaker ledge 27. The ledge 28 extends inwardly as well, but has its outer, largest diameter surface, connected to the upper ledge 27 by an annular, downwardly and inwardly tapered surface 29. As can readily be seen when viewing FIG. 3, the free end 21 of the stop ring 20 is beneath the breaker ledge 27 of the bead 26. The moving or unthreading of the closure 12, as illustrated in FIG. 4, results in the breaking of the bridges 16 since the stop ring 20 cannot move above the bead 26. Thus, after the bridges 16 are broken, the tamper indicating band 15, with the stop ring 20, will fall down and rest on a transfer bead or ledge 30 formed at the lower end of the finish 11 of the bottle 10.

Figure 5:
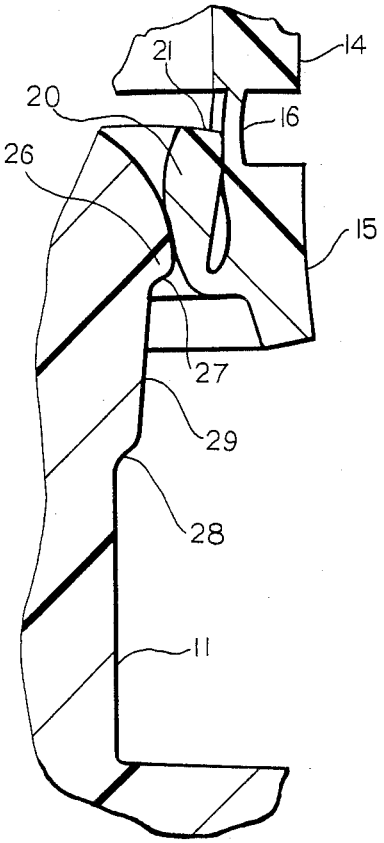
FIG. 5 is a fragmentary sectional view on an enlarged scale showing the closure being applied to the container.
Figure 6:
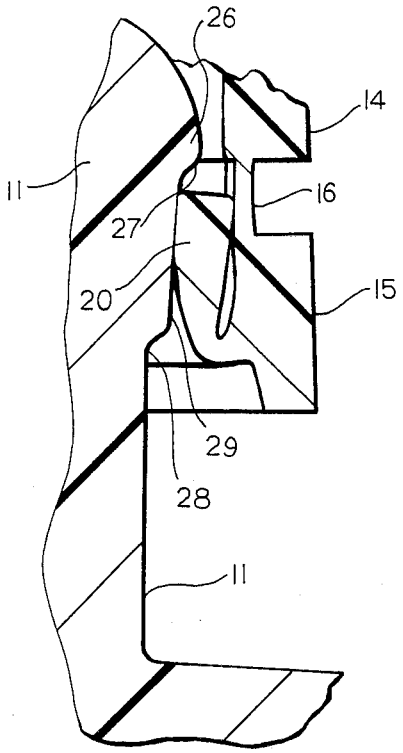
FIG. 6 is a view similar to FIG. 5 showing the closure applied to the container.
Figure 7:
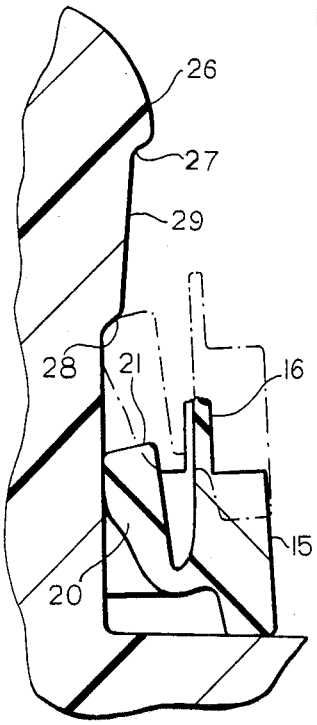
FIG. 7 is a view similar to FIGS. 5 and 6 showing the taper indicating band and container after the closure has been removed.

With particular reference now to FIGS. 5–7, the function of the various ledges will be explained. As shown in FIG. 5, the closure with its skirt 14 and tamper indicating band 15 is moved into place on the container finish 11. The closure is made of a flexible plastic such that the stop ring 20 can pass down over the annular bead 26 formed on the external surface of the container finish 11. The cuts 31 and the 30° angle of the leading edge of the segments, hereinafter discussed, (FIGS. 2, 3 and 4) make this operation much easier. Once the stop ring has passed the bead 26, it will be positioned generally as shown in FIG. 6, with the upper free end 21 of the stop ring 20 below the breaker ledge 27 of the bead 26. Also, the free end 21 of the stop ring will be in engagement with the tapered surface 29 of the container finish and be held in close proximity to the bridges 16. When the threaded closure is removed from the container finish, the stop ring 20 will be prevented from passing back over the bead 26 by the engagement of the end 21 of the stop ring with the ledge 27 of the bead 26. The bridges 16 are frangible and are of insufficient strength to resist breakage when the closure is threaded off the container finish.

As the threaded closure is being threaded off the container finish, some of the eight bridges 16 will break first and as the continued movement of the closure upwardly occurs, the band 15 and its stop ring 20 is somewhat cammed down by the slope of the tapered surface 29 to a certain extent until such time as all of the bridges are severed, at which time the band 15 and the stop ring 21 will fall to the position illustrated in FIGS. 4 and 7. When the band 15 has been totally severed from the closure skirt 14, it is vertually impossible to ever return the band 15 to its initially applied position as shown in FIG. 6, since the upper free end 21 of the stop ring 20 will engage the ledge 28, as illustrated in the dotted position in FIG. 7. Thus, it can be seen that the closure, once it has been removed from the container finish or neck, and even if reapplied, the band 15 will be separated from the cap and will indicate that the closure has been tampered with or removed. It is impossible to restore the band to its initial position by any normal manual manipulation.

Since the band 15 and the stop ring 20 are flexibly joined, the flexure in the bridge between the two members will permit the end 21 of the band 20 to move inwardly and assume the general position illustrated in FIGS. 4 and 7. Since the lower ledge 28 is significantly higher than the transfer bead of the container, and the indicating band 15 will normally rest on the transfer bead 30 after the closure has been tampered with, a fairly large gap will result and the tampering of the closure will be clearly and positively indicated.

In accordance with the invention, the free edge of the continuous flange or stop ring 20 is provided with a plurality of segments 31. Each segment 31 extends from one bridge to the next bridge. In addition, the leading end of each segment is cut at an angle of 30° extending rearwardly with respect to the direction of threading of the closure on the container.

As the closure is threaded on the container, the engagement of the continuous bead 26 with the segments 31 extending upwardly and inwardly with respect to the closure is greatly facilitated and requires a lesser force.

I claim:

1. A tamper indicating package comprising a container having a neck with a threaded finish and an annular bead on the container, a closure which includes a base wall and depending peripheral skirt having threads interengaging the threads of the container, and a tamper indicating band attached to the skirt by a plurality of circumferentially spaced frangible bridge members, a segmented annular flange extending axially upwardly and inwardly from the lower edge of the tamper indicating band towards the base wall of the closure adapted to engage the bead on the container and flex radially inwardly when the closure is threaded on the container and thereafter engage beneath the bead on the container, said annular flange having its free edge formed with a plurality of segments such that the stiffness of the flange is reduced, the leading edge of each segment being at an acute angle extending rearwardly with respect to the direction of threading the closure on the container such that the application of the closure over the bead during the threading of the closure on the container is facilitated.

2. The tamper indicating package set forth in claim 1 wherein said segments extend from one bridge member to the next bridge member.

3. The tamper indicating package set forth in claim 2 wherein said acute angle is about 30°.

4. A tamper indicating closure for a container having a neck with a threaded finish, said closure including a base wall and depending peripheral skirt having threads interengaging the threads of the container, and a tamper indicating band attached to the skirt by a plurality of circumferentially spaced frangible bridge members, a segmented annular flange extending axially upwardly and inwardly from the lower edge of the tamper indicating band towards the base wall of the closure adapted to engage the bead on the container and flex radially inwardly when the closure is threaded on the container and thereafter engage beneath the bead on the container, said annular flange having its free edge formed with a plurality of segments such that the stiffness of the flange is reduced, the leading edge of each segment being at an acute angle extending rearwardly with respect to the direction of threading the closure on the container such that the application of the closure over the bead during the threading of the closure on the container is facilitated.

5. The tamper indicating package set forth in claim 4 wherein said segments extend from one bridge member to the next bridge member.

6. The tamper indicating package set forth in claim 5 wherein said acute angle is about 30°.

* * * * *